US006534464B1

(12) United States Patent
Huish et al.

(10) Patent No.: US 6,534,464 B1
(45) Date of Patent: Mar. 18, 2003

(54) COMPOSITIONS CONTAINING α-SULFOFATTY ACID ESTER AND POLYALKOXYLATED ALKANOLAMIDE AND METHODS OF MAKING AND USING THE SAME

(75) Inventors: Paul Danton Huish, S. L. C., UT (US); Laurie A. Jensen, Midvale, UT (US); Pule B. Libe, Salt Lake City, UT (US)

(73) Assignee: Huish Detergents, Inc., Salt Lake City, UT (US)

( * ) Notice: Subject to any disclaimer, the term of this patent is extended or adjusted under 35 U.S.C. 154(b) by 0 days.

(21) Appl. No.: 09/574,764

(22) Filed: May 19, 2000

(51) Int. Cl.[7] ..... C11D 1/12; C11D 1/72; C11D 1/83

(52) U.S. Cl. ..... 510/350; 510/445; 510/446; 510/447; 510/488; 510/492; 510/400; 510/506; 510/302; 510/320; 510/349; 510/351; 510/360; 510/501

(58) Field of Search ..... 510/128, 137, 510/138, 155, 156, 445, 446, 447, 488, 492, 400, 501, 506, 302, 320, 349, 350, 351, 360

(56) References Cited

U.S. PATENT DOCUMENTS

| | | | |
|---|---|---|---|
| 3,962,107 | A | 6/1976 | Levin et al. |
| 3,997,576 | A | 12/1976 | Oghoshi et al. |
| 4,064,062 | A | 12/1977 | Yurko |
| 4,219,435 | A | 8/1980 | Biard et al. |
| 4,374,056 | A | 2/1983 | Watanabe et al. |
| 4,438,025 | A | 3/1984 | Satsuki et al. |
| 4,476,043 | A | 10/1984 | O'Lenick |
| 4,487,710 | A | 12/1984 | Kaminsky |
| 4,488,989 | A | 12/1984 | Lamberti |
| 4,552,681 | A | 11/1985 | Koch et al. |
| 4,597,868 | A | 7/1986 | Vander Meer |
| 4,705,644 | A | 11/1987 | Barone |
| 4,849,125 | A | 7/1989 | Seiter |
| 4,923,628 | A | 5/1990 | Appel |
| 4,931,202 | A | 6/1990 | Cotter et al. |
| 5,026,400 | A | 6/1991 | Holland et al. |
| 5,104,567 | A | 4/1992 | Staehr |
| 5,133,892 | A | 7/1992 | Chun et al. |
| 5,143,639 | A | 9/1992 | Krawack |
| 5,213,705 | A | 5/1993 | Olson |
| 5,225,100 | A | 7/1993 | Fry et al. |
| 5,324,649 | A | 6/1994 | Arnold |
| 5,380,453 | A | 1/1995 | Krawack |
| 5,382,677 | A | 1/1995 | Colignon |
| 5,387,373 | A | 2/1995 | Naik |
| 5,391,783 | A | 2/1995 | Colignon |
| 5,397,494 | A | 3/1995 | Vega |
| 5,429,773 | A | 7/1995 | Sherry et al. |
| 5,475,134 | A | 12/1995 | Baker |
| 5,482,644 | A | 1/1996 | Nguyen et al. |
| 5,602,089 | A | 2/1997 | Pennaz |
| 5,616,781 | A | 4/1997 | Sajic |
| 5,624,906 | A | 4/1997 | Vermeer |
| 5,637,560 | A | 6/1997 | Raehse |
| 5,637,758 | A | 6/1997 | Sajic |
| 5,688,982 | A | 11/1997 | Khan |
| 5,691,296 | A | 11/1997 | Agar |
| 5,783,540 | A | 7/1998 | Secemski et al. |
| 5,821,207 | A | 10/1998 | Kanai |
| 5,851,976 | A | 12/1998 | Mertens |
| 5,900,399 | A | 5/1999 | Seiter et al. |
| 5,919,747 | A | 7/1999 | Kazuta et al. |

(List continued on next page.)

FOREIGN PATENT DOCUMENTS

EP 0 336 740 B1 1/1995

OTHER PUBLICATIONS

Foster, Norman C., Hovda, Keith D., "Manufacture of Methyl Ester Sulfonates and Other Derivatives", Chemithon, 1997 Seattle, Washington.

Hovda, K., "The Challenge of Methylester Sulfonation", Chemithon, 1997 Seattle, Washington.

Macarthur, Brian W. Brooks, Burt, Sheats, Brad W., Foster, Norman C., "Meeting the Challenge of Methylester Sulfonation", Chemithon, 1998, Seattle, Washington.

Foster, Norman C., "Sufonation and Sufation Processes", Chemithon, 1997, Seattle, Washington.

Hovda, Keith "Methyl Ester Sulfonation: Process Optimization", Chemithon, Seattle, Washington (1993).

Foster, Norman C., Ph. D., P.E., Rollock, Michael, BS ChE., "Medium to Very High Active Single Step Neutralization", Chemithon, Seattle, Washington (1997).

Surfactants. Inform, vol. 7, No. 1 (Jan. 1996), pp. 10–12.

Rao, Y. K., Sajic, B., "Physico–Chemical Properties of Some Salts of Sulfo Methyl Ester Surfactants", 1996, 4$^{th}$ World Surfactants Congress, pp. 382–391.

U.S. patent application Ser. No. 09/574,996, Huish et al., filed Sep. 19, 2000.

U.S. patent application Ser. No. 09/585,684, Huish et al., filed Jun. 1, 2000.

U.S. patent application Ser. No. 09/481,851, Huish et al., filed Jan. 1, 2000.

Technical Bulletin—"Empigen OB/EBA," Albright & Wilson (1996).

Davidsohn and Milwidsky, "Synthetic Detergents," *Longman Scientific & Technical*, 7$^{th}$ ed., pp. 263–264 (1987).

*Primary Examiner*—Gregory Delcotto
(74) *Attorney, Agent, or Firm*—Townsend and Townsend and Crew LLP

(57) ABSTRACT

An α-sulfofatty acid ester and polyalkoxylated alkanolamide composition and method. The α-sulfofatty acid ester is formed into an ester portion, and the polyalkoxylated alkanolamide is formed into an alkanolamide portion. Both portions can optionally include other detergent components. Each portion comprises a plurality of particles, such as a powder or beads, pellets, granules, and the like. Each portion is formed separately, and then the portions are mixed. The portions can be combined in any suitable ratios, according to the desired properties of the final composition.

24 Claims, No Drawings

U.S. PATENT DOCUMENTS 5,945,394 A 8/1999 Sajic et al.
5,958,864 A 9/1999 Gonzalez
5,961,662 A 10/1999 Yamaguchi et al.
5,965,500 A 10/1999 Puvvada
5,965,508 A 10/1999 Ospinal et al.
5,968,891 A 10/1999 Mallari
5,972,861 A 10/1999 Rolfes
5,980,580 A 11/1999 Yamaguchi
6,013,611 A 1/2000 Thomas et al.
6,025,320 A 2/2000 Appel
6,046,151 A 4/2000 Drapier et al.
6,057,280 A 5/2000 Huish
6,060,440 A 5/2000 Sackariasen et al.
6,303,558 B1 10/2001 Emery et al. ..... 510/424

COMPOSITIONS CONTAINING α-SULFOFATTY ACID ESTER AND POLYALKOXYLATED ALKANOLAMIDE AND METHODS OF MAKING AND USING THE SAME

BACKGROUND OF THE INVENTION

The present invention generally relates to surfactant compositions and methods for making and using such compositions. More particularly, the invention relates to compositions containing α-sulfofatty acid esters and polyalkoxylated alkanolamides, and methods for making and using the same.

Detergents have been used for many years to clean clothing and other materials. Detergents originally contained soap derived from animal fats. More recently, surfactants have been included in detergents to enhance their cleaning performance. Typical surfactants include anionic, nonionic and/or cationic surfactants, and those described in "Surface Active Agents and Detergents" Volumes I and II by Schwartz, Perry & Berch, in "Nonionic Surfactants" by M. J. Schick, and in McCutcheon's "Emulsifiers & Detergents," the disclosures of which are incorporated herein by reference. Such surfactants can be combined according to the desired properties of the resulting composition.

Nonionic surfactants provide excellent cleaning properties and can also act as defoaming agents. Nonionic surfactants can be manufactured by alkoxylation of alcohols, fatty acids or esters. For example, nonionic surfactants can be synthesized by ethoxylating an alcohol or fatty acid with ethylene oxide; ethoxylation adds ethoxy groups ($—OCH_2CH_2—$) to the active hydrogen of the alcohol or fatty acid. See, for example, U.S. Pat. Nos. 5,627,121; 4,835,321; 4,820,673; 4,775,653; 4,754,075; 4,239,917; and International Patent Publication No. WO 85/00365, the disclosures of which are incorporated herein by reference. Alkanolamides can also be alkoxylated to form alkoxylated alkanolamides. (See, e.g., U.S. Pat. Nos. 6,034,257 and 6,034,257, the disclosures of which are incorporated herein by reference.) Nonionic surfactants alone, however, generally lack sufficient cleaning performance for laundry detergents, however.

Nonionic surfactants are often combined with anionic surfactants, due to the surface agent properties of the anionic surfactants. The cleaning performance of anionic surfactants can be limited, however, by the water hardness. In particular, calcium and/or magnesium ions in hard water can interfere with anionic surfactants such as alkyl olefin sulfonates, alkyl sulfates, linear alkyl sulfonates, and linear alkyl benzene sulfonates. To overcome the deficiencies of such anionic surfactants, builders can be added to control water hardness. Builders reduce water hardness by "ion exchanging" (e.g., zeolites), by sequestering (e.g., phosphates), or precipitating (e.g., soda ash) calcium and/or magnesium ions, thereby preventing those ions from interfering with the surfactant. Builders can also serve as a source of alkalinity and can prevent the deposition of salts on metal surfaces in washing machines. Typical builders include silicates, polysilicates, phyllosilicates, carbonates and zeolites (such as aluminosilicates). A disadvantage of some builders, however, is that they may cause deposits on clothing.

Recently, interest in α-sulfofatty acid esters (also referred to hereafter as "sulfofatty acids") has increased due to the superior cleaning properties of these surfactants in hard water. For example, methyl ester sulfonate ("MES") has excellent hard water surfactant properties; MES shows increasing cleaning performance as water hardness increases. Such hard water performance is beneficial because hard water is used in many areas of the world for wash water. α-Sulfofatty acid esters can be used in a wide range of detergent applications.

α-Sulfofatty acid esters are typically manufactured as salts. These α-sulfofatty acid ester salts also exhibit surface active agent properties. Sulfofatty acid salts can be a mixture of salt forms, typically mono- and di-salts. For example, MES has both mono- and di-salt forms (i.e., mono-sodium MES and di-sodium MES). Mono-salts of sulfofatty acids generally have superior surfactant properties as compared with the di-salt forms. Mono-salts of MES are unstable, however, and react with moisture and basic substances to form di-salts. Such basic substances include bases and builders. For example, mono-sodium MES reacts with caustic soda (NaOH) in the presence of moisture to form a di-salt by the following chemical reaction:

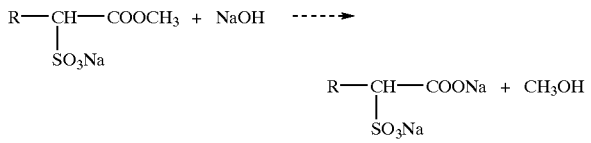

Di-salt formation decreases the surface activity of the surfactant. As the amount of di-salt increases, the amount of the mono-salt correspondingly decreases. To compensate, more mono-salt of the sulfofatty acid must be added to the composition to provide the same level of surface active agent performance, which increases the cost and unit size of the composition.

Thus, there exists a need for detergent compositions containing α-sulfofatty acid ester that provide improved cleaning performance in hard water while sparing the need for builders. There is a further need for a detergent compositions containing α-sulfofatty acid ester that exhibit reduced di-salt formation. The present invention surprisingly satisfies these needs and more.

SUMMARY OF THE INVENTION

The present invention is a composition comprising α-sulfofatty acid ester and polyalkoxylated alkanolamide. The α-sulfofatty acid ester is formed into a first portion, an ester portion. The polyalkoxylated alkanolamide is formed into a second portion, an alkanolamide portion. The alkanolamide and ester portions each comprise a plurality of particles, such as a powder, or beads, pellets, granules, and the like. Each portion is formed separately, and then the portions are admixed, so that the particles are co-mingled. After admixing, however, the particles remain physically distinct. The portions can be combined in any suitable ratios, according to the desired properties of the final composition. In some embodiments, the ester portion and/or the alkanolamide portion can be coated to further reduce the amount of di-salt formation. Other detergent components can also be separately added to the admixture, such as, for example, fragrances, enzymes and the like.

The alkanolamide portion can further comprise other components, according to the desired properties of the final composition. For example, such components can include, but are not limited to, builders, anionic surfactants, other nonionic surfactants, cationic surfactants, zwitterionic surfactants, polymer dispersants, oxidizing agents, biocidal agents, foam regulators, binders, anticaking agents, activators, hydrotropes, catalysts, thickeners, stabilizers, UV protectors, fragrances, soil suspending agents, polymeric soil release agents, fillers, brighteners, enzymes, salts, inert ingredients, and the like. In some embodiments, the alkanolamide portion includes substances which cause more than a minor amount of additional di-salt formation.

The ester portion comprises at least one α-sulfofatty acid ester. In some embodiments, the α-sulfofatty acid ester is the sole component of the ester portion. In such embodiments, the ester portion also includes manufacturing by-products of the α-sulfofatty acid ester(s). In other embodiments, the ester portion further includes other detergent components, such as builders, anionic surfactants, other nonionic surfactants, cationic surfactants, zwitterionic surfactants, polymer dispersants, biocidal agents, foam regulators, binders, anticaking agents, activators, hydrotropes, thickeners, stabilizers, UV protectors, fragrances, soil suspending agents, polymeric soil release agents, fillers, enzymes, salts, inert ingredients, and the like. In still other embodiments, the ester portion is substantially free of other detergent components that cause more than a minor amount of additional di-salt formation. By sequestering the α-sulfofatty acid ester from components that cause more than a minor amount of additional di-salt formation, the amount of additional di-salt formation can be reduced.

The invention further includes methods of making compositions comprising α-sulfofatty acid ester and polyalkoxylated alkanolamide. Such methods generally include providing an alkanolamide portion that contains a polyalkoxylated alkanolamide. An ester portion, containing α-sulfofatty acid ester, is also provided. Each portion is formed separately as a plurality of particles, and then the portions are admixed. In some embodiments, the ester portion is substantially free of components that cause more than a minor amount of di-salt formation, while the alkanolamide portion can include such components.

The present invention also includes methods for manufacturing detergent compositions, or parts of detergent compositions, that have an ester portion and an alkanolamide portion. Such methods generally include providing a polyalkoxylated alkanolamide and other detergent components, combining those components to form an alkanolamide portion, providing an α-sulfofatty acid ester to form an ester portion, and then admixing the portions. Alternatively, other components can also be added as a separate portion(s) to the invented composition.

For any of the compositions and methods in accordance with the present invention, the alkanolamide portion can be formed by, for example, dry-blending, agglomerating, spray drying, fluid bed mixing, as well as by other methods known to the skilled artisan. The ester portion can be formed by, for example, dry-blending, agglomeration and fluid bed mixing. Such methods preferably do not cause more than a minor amount of additional di-salt formation.

DETAILED DESCRIPTION OF THE INVENTION

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent and pharmaceutical industries. Moreover, the processes below describe only steps, rather than a complete process flow, for manufacturing the composition, and detergents containing the composition in accordance with the present invention.

A preferred embodiment is directed to novel compositions comprising α-sulfofatty acid ester and polyalkoxylated alkanolamide. The α-sulfofatty acid ester is formed into a first portion, an ester portion. The polyalkoxylated alkanolamide is formed into a second portion, an alkanolamide portion.

The Ester Portion

In a preferred embodiment, the composition comprises an ester portion containing an α-sulfofatty acid ester. Such esters are typically formed by esterifying a carboxylic acid with an alkanol and then sulfonating the α-position. Such esters are typically of the following formula (I):

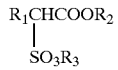

(I)

where $R_1$ is a linear or branched alkyl group, $R_2$ is a linear or branched alkyl group, and $R_3$ is hydrogen, a halogen, a metal, or an unsubstituted or substituted ammonium cation. $R_1$ can be a $C_4$ to $C_{24}$ alkyl group including a $C_{10}$, $C_{12}$, $C_{14}$, C16, and/or $C_{18}$ alkyl group. $R_2$ can be a $C_1$ to $C_8$ alkyl group, including a methyl group. $R_3$ is typically a monovalent or di-valent including a cation which forms a water soluble salt with the α-sulfofatty acid ester, including an alkali metal such as sodium, potassium, lithium, calcium or magnesium. The α-sulfofatty acid ester of formula (I) can be a methyl ester sulfonate, such as a $C_{16}$ methyl ester sulfonate, a $C_{18}$ methyl ester sulfonate, or a mixture thereof.

More typically, the α-sulfofatty acid ester is a salt. Such salts are generally of the following formula (II):

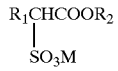

(II)

where $R_1$ and $R_2$ are linear alkanes and M is a monovalent metal. For example, $R_1$ can be an alkane containing 6 to 22 carbon atoms, and is typically a $C_{10}$, $C_{12}$, $C_{14}$, $C_{16}$ and/or $C_{18}$ alkane. $R_2$ is typically an alkyl group containing 1 to 8 carbon atoms, and more typically a methyl group. M is an alkali metal, typically sodium. The α-sulfofatty acid ester of formula (II) can be a sodium salt of methyl ester sulfonate, such as a $C_{16}$ sodium methyl ester sulfonate, a $C_{18}$ sodium methyl ester sulfonate, or a mixture thereof.

The ester portion can comprise one or more α-sulfofatty acid esters. As will be appreciated by the skilled artisan, the type and proportion of α-sulfofatty acid ester(s) can be selected according to the properties of the sulfofatty acid(s) and the desired properties of the composition. For example, the α-sulfofatty acid ester can be a $C_{12}$, $C_{14}$, $C_{16}$ or $C_{18}$ sulfofatty acid. In other embodiments, the ester portion can comprise a mixture of α-sulfofatty acid esters. For example, the ester portion can comprise $C_{12}$, $C_{14}$, $C_{16}$ and/or $C_{18}$ sulfofatty acids. Such mixtures can be selected according to the properties of the α-sulfofatty acid esters. For example, $C_{16}$ and $C_{18}$ sulfofatty acids (e.g., from tallow and/or palm stearin MES) generally provide better surface active agent properties, but can be less soluble. $C_{12}$ and $C_{14}$ sulfofatty acids (e.g., from palm kernel and/or coconut MES) are more soluble in water, but have lesser surface active agent properties. Suitable mixtures of sulfofatty acid can include, for example, about 1 to about 99 weight percent of a $C_{16}$ or $C_{18}$ α-sulfofatty acid ester and about 99 to about 1 weight percent of a $C_{18}$ or $C_{16}$ α-sulfofatty acid ester. Other suitable mixtures include $C_{12}$ and/or $C_{14}$ sulfofatty acid combined with a $C_{16}$ and/or $C_{18}$ sulfofatty acid. For example, about 1 to about 99 percent of $C_{12}$ and/or $C_{14}$ sulfofatty acid can be combined with about 99 to about 1 weight percent of $C_{16}$ and/or $C_{18}$ sulfofatty acid. In still other embodiments, the α-sulfofatty acid ester is a mixture of $C_{18}$ methyl ester sulfonate and a $C_{16}$ methyl ester sulfonate and having a ratio of about 2:1 to about 1:3. Other mixtures of sulfofatty acids are also within the scope of the present invention, as will be appreciated by the skilled artisan.

Methods of manufacturing α-sulfofatty acid esters are known to the skilled artisan. (See, e.g., U.S. Pat. Nos. 5,587,500; 5,329,030; 5,382,677; 5,384,422; 4,671,900; 4,816,188; and The Journal of American Oil Chemists Society, 52:323–29 (1975); the disclosures of which are incorporated herein by reference.) α-Sulfofatty acid esters can be manufactured from a variety of sources, including beef tallow, palm kernel oil, palm stearin oil, coconut oil, soybean oil, canola oil, cohune oil, coco butter, palm oil, white grease, cottonseed oil, corn oil, rape seed oil, soybean oil, yellow grease, and mixtures or fractions thereof. Thus, in some embodiments, the α-sulfofatty acid ester is a mixture of different chain lengths from one or more of these sources.

The ester portion can also be enriched for particular α-sulfofatty acid ester(s), as disclosed in co-pending U.S. patent application Ser. No. 09/574,996 to provide the desired surfactant properties. (The disclosure of that application is incorporated by reference herein.) For example, sulfofatty acids made from palm stearine, palm kernel, or beef tallow oils can be enriched for $C_{16}$ α-sulfofatty acid esters.

Other sources of fatty acids to make α-sulfofatty acid esters include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. α-Sulfofatty acid esters made from one or more of these sources are within the scope of the present invention.

Detergent compositions in accordance with the present invention contain an effective amount of at least one α-sulfofatty acid ester (i.e., an amount that exhibits the desired cleaning and surfactant properties). In some embodiments, an effective amount is at least about 5 weight percent. In other embodiments, an effective amount is at least about 10 weight percent. In still other embodiments, an effective amount is at least about 25 weight percent, or more preferably, at least about 30 weight percent or at least about 35 weight percent. These weight percentages are based on the weight of the entire composition.

The Alkanolamide Portion

The polyalkoxylated alkanolamide portion is generally of the following formula (III):

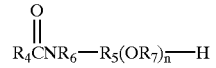

$$R_4\overset{\overset{\displaystyle O}{\|}}{C}NR_6—R_5(OR_7)_n—H \quad \text{(III)}$$

where $R_4$ is an alkyl or hydroalkyl group, $R_5$ is an alkyl group and n is a positive integer. $R_4$ is typically an alkyl group containing 6 to 22 carbon atoms. $R_5$ is typically an alkyl group containing 1–8 carbon atoms. $R_7$ is typically an alkyl group containing 1 to 4 carbon atoms, and more typically an ethyl group. The degree of polyalkoxylation (the molar ratio of the oxyalkyl groups per mole of alkanolamide) can range from about 1 to about 100, or from about 3 to about 8, or about 5 to 6. $R_6$ can be hydrogen, an alkyl group, a hydroalkyl group or a polyalkoxylated alkyl group. The polyalkoxylated alkanolamide is typically a polyalkoxylated monoalkanolamide.

Methods of manufacturing polyalkoxylated alkanolamides are known to the skilled artisan. (See, e.g., U.S. Pat. Nos. 6,034,257 and 6,034,257, the disclosures of which are incorporated by reference herein.) Sources of fatty acids for the manufacture of such alkanolamides can include beef tallow, palm kernel oil, palm stearin oil, coconut oil, soybean oil, canola oil, cohune oil, palm oil, white grease, cottonseed oil, and mixtures or fractions thereof. Other sources include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. Polyalkoxylated alkanolamides from one or more of these sources are within the scope of the present invention.

Detergent compositions in accordance with the present invention contain an effective amount of at least one polyalkoxylated alkanolamide (e.g., an amount which exhibits the desired surfactant properties). Typically, the detergent compositions contain at least about one weight percent of one or more polyalkoxylated alkanolamides. More preferably, the detergent compositions contain at least about five weight percent polyalkoxylated alkanolamide.

The polyalkoxylated alkanolamide is typically mixed with any suitable proportions of other detergent components, according to the desired properties of the final composition. Such components include builders, anionic surfactants, other nonionic surfactants, cationic surfactants, zwitterionic surfactants, polymer dispersants, oxidizing agents, biocidal agents, foam regulators, binders, anticaking agents, activators, hydrotropes, catalysts, thickeners, stabilizers, UV protectors, fragrances, soil suspending agents, polymeric soil release agents, fillers, brighteners, enzymes, salts, inert ingredients, and the like.

Suitable builders include silicates, including polysilicates and alkali metal silicates. One suitable alkali metal silicate is sodium silicate, such as a hydrous sodium silicate having an $SiO_2$ to $Na_2O$ ratio ranging from about 2.0 to about 2.5, including those sold by PQ Corporation under the trade names BRITESIL® H20, BRITESIL® H24, and BRITESIL® C-24. Other suitable silicates include wholly or partially crystallite layer-form silicates of the formula $Na_2Si_x.O_{2x+1}\ yH_2O$, where x ranges from about 1.9 to about 4 and y ranges from 0 to about 20. Such silicates are described, for example, in U.S. Pat. No. 5,900,399, the disclosure of which is incorporated herein by reference.

Other suitable builders include phyllosilicates or disilicates. Disilicates that can be employed in compositions in accordance with the present invention include those having the formula $Na_2O.2SiO_2$ or $Na_2Si_2O_5.yH_2O$, where y is an integer. Preferred disilicates include β-sodium disilicates, such as those described in International Patent Publication WO 91/08171, the disclosure of which is incorporated herein by reference. Disilicates sold under the trade names SKS® 6 and SKS® 7 by Hoescht AG and Clariant Corporation can also be employed in the present invention.

Builders can also include silicated salts. The term "silicated salt" means a salt, such as a carbonate, sulfate, alkali metal carbonate, alkali metal sulfate, ammonium carbonate, bicarbonate, sesquicarbonate, or mixtures thereof, that has been treated with a silicate salt. Silicated salts can be prepared, for example, according to the method disclosed in U.S. Pat. No. 4,973,419, and references disclosed therein, the disclosures of which are incorporated herein by reference.

Other builders include phosphate-containing builders, such as, for example, alkali metal phosphates, orthophosphates, polyphosphates, tripolyphosphates, pyrophosphates, and polymer phosphates, and aluminosilicate builders (zeolites). Aluminosilicate builders include those of the following formulae (IV) and (V):

$$Na_x[(AlO_2)_z(SiO_2)_y].xH20 \quad (IV)$$

where z and y are integers greater than 5, x is an integer ranging from 15 to 264, and the molar ratio of z to y ranges from about 1.0 to about 0.5; and $$M_z(zAlO_2.ySiO_2) \quad (V)$$

where M is sodium, potassium, ammonium, or substituted ammonium, z ranges from about 0.5 to about 2, and y is 1. Examples of such aluminosilicate builders include zeolite NaA, zeolite NaX, zeolite P, zeolite Y, hydrated zeolite 4A, and zeolite MAP (maximum aluminum zeolite; see EP 384 070A). In another embodiment, the alkanolamide portion contains less than about one weight percent of aluminosilicates and/or phosphate. In still another embodiment, the composition is substantially free of aluminosilicates and phosphates.

Suitable polymer dispersants include polymers of acrylic acid, methacrylic acid, maleic acid, fumaric acid, itaconic acid, co-polymers thereof, and water-soluble salts thereof, such as alkali metal, ammonium, or substituted ammonium salts. Suitable polymer dispersants further include those sold under the trade names ACUSOL® 445 (polyacrylic acid), ACUSOL® 445N (polyacrylic acid sodium salt), ACUSOL® 460N (a maleic acid/olefin copolymer sodium salt), and ACUSOL® 820 (acrylic copolymer), sold by Rohm and Haas Company.

Suitable nonionic surfactants can include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference.

In another embodiment, the alkanolamide portion is substantially free of nonylphenol nonionic surfactants. In this context, the term "substantially free" means less than about one weight percent.

Anionic surfactants can optionally be included in the alkanolamide portion. Suitable anionic surfactants include alkylbenzenesulfonates, alkyl or alkenyl ether sulfates, alkyl or alkenyl sulfates, olefin sulfonates, alkyl or alkenyl ether carboxylates, amino acid-type surfactants, N-acyl amino acid-type surfactants, and those disclosed in U.S. Pat. Nos. 5,945,394 and 6,046,149, the disclosures of which are incorporated herein by reference.

Suitable oxidizing agents include chlorine and non-chlorine-containing oxidizing agents. Suitable non-chlorine oxidizing agents include oxygen bleaches, such as perborates, percarbonates, persulfates, dipersulfates, sodium carbonate peroxyhydrate, sodium pyrophosphate peroxyhydrate, urea peroxyhydrate, and sodium peroxide. Other suitable non-chlorine oxidizing agents include bleach activators, such as N,N,N',N'-tetraacetyl ethylene diamine (TAED), sodium benzoyl oxybenzene sulfonate, choline sulfophenyl carbonate, and those described in U.S. Pat. Nos. 4,915,854 and 4,412,934, the disclosures of which are incorporated herein by reference. Suitable non-chlorine oxidizing agents further include a catalyst such as manganese or other transition metal(s) in combination with oxygen bleaches.

Suitable oxidizing agents include percarboxylic acid bleaching agents and salts thereof, such as magnesium monoperoxyphthalate hexahydrate and the magnesium salts of meta-chloro perbenzoic acid, 4-nonylamino-4-oxoperoxybutyric acid and diperoxydodecanedioic acid. Oxidizing agents can also include those described in U.S. Pat. Nos. 4,483,781, 4,634,551, and 4,412,934, the disclosures of which are incorporated herein by reference herein.

Oxidizing agents further include non-oxygen containing oxidizing agents, such as photoactivated bleaching agents. Suitable photoactivated bleaching agents include sulfonated zinc and metal phthalocyanines, such as aluminum and zinc phthalocyanines. Other suitable photoactivated bleaching agents are described in U.S. Pat. No. 4,033,718, the disclosure of which is incorporated herein by reference.

The oxidizing agent can also be a chlorine-containing agent. The chlorine-containing agent can be any suitable anhydrous agent containing chlorine, such as organic and/or inorganic compounds capable of having their chlorine liberated in the form of active chlorine on dissolution in water. Typical examples of such chlorine-containing agents include the following: hypochlorites such as alkali metal (calcium and lithium) hypochlorites; chlorinated trisodium phosphate; chlorinated sulphonamides; halogenated hydantoins, such as 1,3-dicloro-5,5-dimethylhydantoin; polychlorocyanurates (usually containing alkali metals such as sodium or potassium salts); chlorine-substituted isocyanuric acid; alkali-metal salts of isocyanuric acid, such as potassium or sodium dihydrate; and other anhydrous chlorine-containing agents known in the detergent industry. Typically, the anhydrous chlorine-containing agent is sodium dichloroisocyanurate-dihydrate.

Suitable biocidal agents include TAED, TAED combined with a persalt, triclosan (5-chloro-2 (2,4-dichloro-phenoxy) phenol)), and quaternary ammonium compounds such as alkyl dimethyl ammonium chlorides, alkyl trimethyl ammonium chlorides, dialkyl dimethyl ammonium chlorides, benzalkonium chloride, parachlorometaxylene, and alkyl dimethyl benzyl ammonium chloride. Other biocidal agents include those sold under the trademarks BARDAC® (quaternary ammonium compounds, dialkyl dimethyl ammonium chlorides) and BARQUAT® (quaternary ammonium compounds, alkyl dimethyl benzyl ammonium chlorides) by the Lonza Group and those sold under the trademark BTC® (dimethyl ammonium chlorides) by the Stepan Company.

Suitable optical brighteners include stilbenes such as TINOPAL® AMS sold by Ciba Geigy, distyrylbiphenyl derivatives such as TINOPAL® CBS-X sold by Ciba Geigy, stilbene/naphthotriazole blends such as TINOPAL® RA-16 sold by Ciba Geigy, oxazole derivatives, and coumarin brighteners.

Suitable enzymes include any of those known in the art, such as amylolytic, proteolytic or lipolytic type, and those listed in U.S. Pat. No. 5,324,649, the disclosure of which is incorporated herein by reference. One preferred protease, sold under the trademark SAVINASE® by NOVO Industries A/S, is a subtillase from *Bacillus lentus*. Other suitable enzymes include amylases, lipases, and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME™ (protein-engineered variant of LIPOLASE), TERMAMYL® (bacterial amylase), BAN (Bacterial Amylase Novo), CELLUZYME® (fingal enzyme), and CAREZYME® (monocomponent cellulase), sold by Novo Industries A/S.

Suitable hydrotropes, which are compounds that increase the solubility of organic compounds, include, for example, urea, sodium and potassium toluene sulfonate, sodium and potassium xylene sulfonate, sodium and potassium cumene sulfonate, trisodium and tripotassium sulfosuccinate, and related compounds (as disclosed in U.S. Pat. No. 3,915,903, the disclosure of which is incorporated herein).

Fillers and salts include inorganic salts such as sodium and potassium sulfate, ammonium chloride, sodium and potassium chloride, sodium bicarbonate, sodium carbonate, and the like.

Polymeric soil release agents comprise another component for mixture with the polyalkoxylated alkanolainide. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures. Suitable release agents include polyhydroxy fatty acid amnide, sulfonated products of a substantially linear ester oligomer comprised of an oligomeric ester backbone of terephthaloyl and oxyalkyleneoxy repeat units and terminal moieties covalently attached to the backbone. Such sulfonated linear esters can be derived from allyl alcohol ethoxylate, dimethyl terephthalate, and 1,2 propylene diol. These soil release agents are described in U.S. Pat. No. 5,958,451, the disclosure of which is incorporated herein by reference. Other suitable polymeric soil release agents include the ethyl- or methyl-capped 1,2-propylene terephthalatepolyoxyethylene terephthalate polyesters (see, e.g., U.S. Pat. No. 4,711,730), anionic end-capped oligomeric esters (see, e.g., U.S. Pat. No. 4,721,580), anionic, especially sulfoaryl, end-capped terephthalate esters (see, e.g. U.S. Pat. No. 4,877,896), all of these patents being incorporated herein by reference.

Suitable soil suspending agents include polyhydroxy fatty acid amides, cellulosic derivatives such as hydroxyether cellulosic polymers, copolymeric blocks of ethylene terephthalate or propylene terephthalate with polyethylene oxide or polypropylene oxide terephthalate, and the like. Cellulosic derivatives that are functional as soil release agents are commercially available and include hydroxyethers of cellulose such as METHOCEL® (Dow Chemical).

The ester portion comprises at least one α-sulfofatty acid ester. In some embodiments, the ester portion contains only α-sulfofatty acid ester, and its manufacturing by-products. In other embodiments, the ester portion optionally further includes other detergent components, including any of those described above. In still other embodiments, the ester portion is substantially free of other detergent components that cause more than a minor amount of additional di-salt formation. As used herein, the term less than a minor amount means less than about 30 weight percent, preferably less than about 15 weight percent, and more preferably less than about 7 weight percent additional di-salt formation. Most preferably, such components promote less than about 1% additional di-salt formation. The preceding ranges apply to additional di-salt formation and exclude di-salt already present in the α-sulfofatty acid ester as a result of the manufacturing process. The method of George Battaglini et al., *Analytical Methods for Alpha Sulfo Methyl Tallowate*, JOACS, Vol. 63, No. 8 (August 1986), the disclosure of which is incorporated herein by reference, can be used to determine the amount of di-salt in an α-sulfofatty acid ester sample, and any increase in such a sample as compared with a control sample.

As will be appreciated by the skilled artisan, the alkanolamide portion can further include other components.

The alkanolamide portion and the ester portion are formed separately. Each portion comprises a plurality of particles, such as a powder or beads, pellets, granules, and the like. The portions are then admixed, so that the particles are commingled. After admixing, however, the particles remain physically distinct. The particles can be substantially homogeneous, structured, at least partially crystalline or amorphous.

Suitable methods for forming the alkanolamide portion can include agglomeration, spray drying, dry blending, fluid bed mixing and similar methods known to the skilled artisan. The alkanolamide portion can also be formed by mixing and granulating in a high-speed mixer/granulator. This step can, be followed by further processing in a moderate-speed mixer/granulator, and then cooling and optionally drying in a fluidized bed. The alkanolamide portion can include any of the components described herein as well a s other components known to the skilled artisan. Water or other solvents can be used in forming this portion. Following mixing, the alkanolamide portion is optionally at least partially dried to remove excess moisture. The moisture content of the alkanolamide portion can be reduced to less than about 10 percent by weight, to less than about 6 weight percent, or more typically to between about 1 to about 3 weight percent. By removing excess moisture before admixing the alkanolamide portion with the ester portion, the amount of additional di-salt formation can be reduced. the ester portion is formed from one or more α-sulfofatty acid esters. For example, the ester portion is formed from pure α-sulfofatty acid ester or from a mixture of α-sulfofatty acid esters, such as by shaving or granulating larger blocks, pieces or chunks of one or more α-sulfofatty acid esters, by aliquoting portions of liquid α-sulfofatty acid esters, or a combination thereof. In other embodiments, the ester portion is formed by combination of at least one α-sulfofatty acid esters with other detergent components. For example, the ester portion can be formed by dry-blending, agglomeration, fluid bed mixing, and the like, at least one α-sulfofatty acid ester with other detergent components described herein as well as those known to the skilled artisan. The methods of forming the ester portion preferably do not cause more than a minor amount of additional di-salt formation.

In some embodiments of the invention, the alkanolamide portion is formed by dry-blending one or more polyalkoxylated alkanolamides and other detergent components. For example, sodium carbonate can be combined with an ethoxylated alkanolamide. After the alkanolamide is absorbed by the carbonate, other ingredients, such as brightener and sodium metasilicate, are then added to the mixture to form the alkanolamide portion. That portion is optionally dried to reduce its moisture content. One or more enzymes or fragrance, for example, can optionally be admixed with the alkanolamide portion or added as separate, adjuvant portions.

In other embodiments, the alkanolamide portion can be formed by agglomeration. For example, one or more polyalkoxylated alkanolamides can be blended with an inert ingredient such as soda ash. The mixture is then agglomerated with a silicate, such as sodium silicate, and optionally, a polymer dispersant. Following agglomeration, the mixture is dried using a fluid bed dryer or conditioner to form the alkanolamide portion. The dried mixture is then screened, and the oversize particles are ground to the desired size. Following screening, fragrance, an oxidizing agent (e.g., peroxide) and/or enzymes can optionally be added to the alkanolamide portion or added as a separate adjuvant portion.

In another embodiment, the alkanolamide portion is formed by spray drying. Briefly, detergent components, such as, for example, water, soda ash, brightener, silicate and polymer dispersant (e.g., polyacrylate), are spray dried and then passed through a lump breaker and/or screens. The moisture content of the alkanolamide portion is typically between about 1 to about 6 weight percent. Other methods of forming the alkanolamide portion are also within the scope of the invention, as will be appreciated by the skilled artisan.

Following any of the embodiments described above, the ester portion is admixed with the alkanolamide portion. The ester portion is typically post-added to the ester portion. The ester portion can be formed from larger pieces, blocks or chunks, or can be added as granules, pellets, beads or as a powder. Alternatively, the ester portion can be formed by dry-blending, agglomerating or fluid bed mixing α-sulfofatty acid ester(s) with one or more other detergent components.

In another embodiment, the ester portion is substantially free of detergent components that cause more than a minor amount of di-salt formation. Components causing more than a minor amount of additional di-salt formation can include, for example, chlorine-containing agents, alkali salts, basic substances, persalts such as sodium perborate or sodium percarbonate, and zeolites, such as zeolite A. In such embodiments, the components that cause more than a minor amount of additional di-salt formation are typically included in the alkanolamide portion or can be added to the composition as distinct portions.

The α-sulfofatty acid ester portion or alkanolamide portion can optionally be at least partially coated to protect the α-sulfofatty acid ester from additional di-salt formation. Such a coating can prevent the interaction of the α-sulfofatty acid ester with bases, moisture, and other di-salt causing substances. Such a coating can be water-resistant. The coating typically can have a melting point within normal washing temperatures, or it can be water-soluble. For a water-soluble coating, it is not necessary that the coating have a melting point within the range of normal washing temperatures.

Suitable coatings include, for example, polyvinyl alcohol, partially or fully hydrolyzed polyvinyl alcohol, polyvinyl acetate, polyvinyl pyrrolidone, polyvinylmethylmethacrylate copolymer, maleic acid/acrylic acid copolymer, ethylene/maleic anhydride copolymer, polyethylene glycol, acrylic acid polymer, carboxymethyl cellulose, cellulose ether, paraffin waxes, fatty acids, methyl ester sulfonate, soaps, waxes, water-soluble polymers, water-swellable polymers, or copolymers, salts or mixtures of any of these.

The coating can be applied to a portion according to techniques used in the detergent and pharmaceutical industries, as will be appreciated by the skilled artisan. Examples of suitable techniques for applying a coating include dip coating, spin coating, spray coating, spray drying (including spray drying using counter-current or co-current techniques), agglomeration and coating using a fluid bed dryer. Suitable fluid bed dryers include, for example, static, vibrating, high-shear granulating, vacuum fluid bed, tablet pan coating, rotor processing and wurster high speed fluid bed dryers. Following application of a coating to a portion, the coating can be dried, as necessary, to remove excess moisture or other liquid.

Other embodiments of the present invention are exemplified in the following examples, which illustrate embodiments of the present invention, although the invention is not intended to be limited by or to these examples.

EXAMPLES

In these examples, the percentages are given as weight percents, and the weight percentages are based on the total weight of the composition, unless otherwise indicated.

Example 1

An alkanolamide portion is prepared as follows: a polyalkoxylated alkanolamide is mixed with soda ash until the alkanolamide is absorbed by the soda ash. Sodium silicate builder (2.4:1), sodium chloride or sodium sulfate, polyacrylate, brightener, and a perfume are then agglomerated with the alkanolamide/soda ash mixture. Following agglomeration, the alkanolamide portion is dried to reduce the moisture content to between about 1 to about 6 percent moisture by weight. An ester portion comprising at least one α-sulfofatty acid ester is then admixed with the alkanolamide portion to form a substantially homogeneous mixture of particles.

Example 2

An alkanolamide portion is prepared as follows: a polyalkoxylated alkanolamide is mixed with a builder, a polymer dispersant, filler, perfume and brightener. These components are mixed by spray drying. An ester portion, comprising α-sulfofatty acid ester, is then post-added to the alkanolamide portion. The final proportions of the components are as follows:

| component | weight percent |
|---|---|
| α-sulfofatty acid ester | 10–50% |
| polyalkoxylated alkanolamide | 0.1–5% |
| sodium silicate | 2–5% |
| filler | 0–10% |
| polymer dispersant | 4–6% |
| brightener | 0.1–0.2% |
| perfume | 0.2–0.4% |
| soda ash | balance |
| total moisture of alkanolamide portion | 1–3% |

Example 3

An alkanolamide portion is prepared as follows: a $C_{16}$ and/or $C_{18}$ ethoxylated alkanolamide is mixed with a sodium silicate builder (2.4:1), sodium chloride or sodium sulfate, polyacrylate, brightener, perfume and soda ash. These components are mixed by agglomeration. Following agglomeration, the alkanolamide portion is dried to reduce the moisture content to between about 1 to about 3 weight percent. The alkanolamide portion is then combined with powdered methyl ester sulfonate (from tallow or palm stearin). The final proportions are as follows:

| component | weight percent |
|---|---|
| methyl ester sulfonate | 35% |
| ethoxylated alkanolamide | 0.1–5% |
| sodium silicate | 2–5% |
| polyacrylate | 4–6% |
| filler | 0–10% |
| brightener | 0.1–0.2% |
| perfume | 0.2–0.4% |
| soda ash | balance |
| total moisture of alkanolamide portion | 1 –3% |

Example 4

A base composition is prepared in the following proportions:

| component | weight percent |
|---|---|
| soda ash | 77.8 |
| sodium silicate solids | 10 |
| ACUSOL ® 445N dispersant (Rohm and Haas) | 10 |
| brightener | 0.2 |
| water | 2 |

The base mixture is combined with a polyalkoxylated alkanolamide and is mixed by agglomeration or spray drying to form a powder. The moisture content of the powder is within the range of about 1 to about 3 weight percent. A powdered (α-sulfofatty acid ester portion is then admixed with the alkanolamide portion to form a detergent composition.

Example 5

Four α-sulfofatty acid ester compositions tested to determine the effect of post-adding α-sulfofatty acid ester to other detergent components. The compositions contained the following components (in weight percentages):

| | A | B | C | D |
|---|---|---|---|---|
| $C_{16}$ α-sulfofatty acid ester | 12 | 25 | 12 | 25 |
| Sodium Silicate | 7 | 7 | 7 | 7 |
| Sodium Carbonate | 81 | 68 | 88 | 75 |

The compositions were incubated at incubated in a humidity chamber at 104° F. and 80% humidity. Samples were removed at different times ("elapsed time") and tested for amount of di-salt formed. The ratio of di-salt to mono-salt is calculated as follows:

$$\frac{\textit{amount of di-salt formed} - \textit{original di-salt content}}{\textit{total amount of active}(\textit{mono-salt and di-salt})}$$

This ratio is also referred to as the "% di-salt/active."

Without Post-Adding α-Sulfofatty Acid Ester

| Formula | Elapsed Time (Days) | SASME % mono-salt | SASCA %di-salt | Total Actives | % Di-Salt/ Active |
|---|---|---|---|---|---|
| A | 0 | 10.3 | 0.24 | 10.5 | 0 |
| | 8 | 7.0 | 0.42 | 7.5 | 2.4 |
| | 15 | 7.2 | 0.60 | 7.8 | 4.6 |
| B | 0 | 21.3 | 1.0 | 22.3 | 0 |
| | 8 | 12.6 | 1.6 | 14.2 | 4.2 |
| | 15 | 13.2 | 1.8 | 15.0 | 5.3 |

Post-Adding α-Sulfofatty Acid Ester

| Formula | Elapsed Time (Days) | SASME % mono-salt | SASCA %di-salt | Total Actives % | % Di-Salt/ Active |
|---|---|---|---|---|---|
| C | 0 | 10.3 | 0.24 | 10.5 | 0 |
| | 8 | 10.3 | 0.25 | 10.6 | 0.1 |
| | 15 | 10.1 | 0.42 | 10.5 | 1.7 |
| D | 0 | 21.3 | 1.0 | 22.3 | 0 |
| | 8 | 18.0 | 1.1 | 19.1 | 0.5 |
| | 15 | 19.2 | 1.1 | 20.3 | 0.5 |

As can be seen by comparing examples A and C, or B and D, by separately adding the α-sulfofatty acid ester to the other detergent components, a higher percentage of total active α-sulfofatty acid ester is retained in the post-added compositions after incubation in the humidity chamber. The ratio of the % di-salt to active is also correspondingly lower. Thus, separately adding the α-sulfofatty acid ester to detergent compositions containing di-salt-forming substances reduces di-salt formation.

Having thus described in detail the preferred embodiments of the present invention, it is to be understood that the invention defined by the appended claims is not to be limited by particular details set forth in the above description, as many apparent variations thereof are possible without departing from the spirit or scope thereof.

What is claimed is:

1. A granular or powdered detergent composition having reduced di-salt formation, comprising:

particles comprising a polyalkoxylated alkanolamide; and particles consisting of at least one α-sulfofatty acid ester, the particles being admixed to form a mixture of physically distinct particles.

2. The composition of claim 1, wherein the α-sulfofatty acid ester is sodium methyl ester sulfonate.

3. The composition of claim 2, wherein the α-sulfofatty acid ester is a $C_{16}$ methyl ester sulfonate, a $C_{18}$ methyl ester sulfonate or a mixture thereof.

4. The composition of claim 3, wherein the α-sulfofatty acid ester is a mixture of $C_{16}$ methyl ester sulfonate and $C_{18}$ methyl ester sulfonate and having a ratio of between about 2:1 and about 3: 1.

5. The composition of claim 1, wherein the α-sulfofatty acid ester is prepared from beef tallow, palm kernel oil, palm stearin oil, coconut oil, soybean oil, canola oil, cohune oil, coco butter, palm oil, white grease, cottonseed oil, corn oil, rape seed oil, soybean oil, yellow grease, or mixtures or fractions thereof.

6. The composition of claim 1, wherein the alkanolamide particles further comprise a builder, a surfactant, a polymer dispersant, an oxidizing agent, a biocidal agent, a foam regulator, a binder, an anticaking agent, an activator, a catalyst, a thickener, a stabilizer, a fragrance, a soil suspending agent, a filler, a brightener, a UV protectant, an enzyme, or a mixture thereof.

7. The composition of claim 6, wherein the builder is sodium silicate, polysilicate, amorphous silicate, phyllosilicate or silicated soda ash.

8. The composition of claim 1, wherein the moisture content of the alkanolamide particles is between about 1 to about 6 weight percent.

9. The composition of claim 1, wherein the composition has less than about one weight percent zeolite.

10. The composition of claim 1, wherein the composition is substantially free of nonylphenol nonionic surfactant.

11. A granular or powdered detergent α-sulfofatty acid ester composition having reduced di-salt formation, comprising:

particles comprising a polyalkoxylated alkanolamide and components that cause more than a minor amount of additional di-salt formation; and particles consisting of at least one α-sulfofatty acid ester, the ester formation;

the particles being admixed to form a mixture of physically distinct particles.

12. The composition of claim 11, wherein the particles comprise a powder, or pellets, granules or beads.

13. The composition of claim 11, wherein the α-sulfofatty acid ester is sodium methyl ester sulfonate.

14. The composition of claim 13, wherein the methyl ester sulfonate is prepared from beef tallow, palm kernel oil, palm stearin oil, coconut oil, soybean oil, canola oil, cohune oil, coco butter, palm oil, white grease, cottonseed oil, corn oil, rape seed oil, soybean oil, yellow grease, or mixtures or fractions thereof.

15. The composition of claim 11, wherein the alkanolamide particles further comprise a builder, a surfactant, a polymer dispersant, an oxidizing agent, a biocidal agent, a foam regulator, a binder, an anticaking agent, an activator, a catalyst, a thickener, a stabilizer, a fragrance, a soil suspending agent, a filler, a brightener, a UV protectant, an enzyme, or a mixture thereof.

16. The composition of claim 11, further comprising:

adjuvant particles.

17. The composition of claim 16, wherein the adjuvant particles comprise an enzyme, a fragrance or an oxidizing agent.

18. A granular or powdered detergent α-sulfofatty acid ester composition having reduced di-salt formation, formed by:

providing particles comprising a polyalkoxylate alkanolamide and another component to form a first plurality of particles, the other component causing more than a minor amount of additional di-salt formation;

providing a second plurality of particles said particles consisting of at least α-sulfofatty-acid ester the second plurality of particles post-added to and mixed with the first plurality of particles, wherein the particles remain physically distinct.

19. The composition of claim 18, further formed by:

reducing the moisture content of the alkanolamide particles.

20. A granular or powdered detergent composition, comprising:

particles comprising a polyalkoxylated alkanolamide and another detergent component; and particles consisting of at least one α-sulfofatty acid ester, the ester particles and the alkanolamide particles being admixed, wherein the particles remain physically distinct, whereby di-salt formation by the α-sulfofatty acid ester is reduced.

21. The composition of claim 20, wherein the particles are a powder, pellets, beads, or granules.

22. The composition of claim 20, wherein the α-sulfofatty acid ester is a sodium methyl ester sulfonate.

23. The composition of claim 20, wherein the α-sulfofatty acid ester comprises $C_6$, $C_8$, $C_{10}$, $C_{12}$, $C_{14}$, $C_{16}$, $C_{18}$, $C_{20}$, $C_{22}$, $C2_4$ α-sulfofatty acid ester or a mixture thereof.

24. The composition of claim 20, wherein the alkanolamide particles further comprise a builder, a surfactant, a polymer dispersant, an oxidizing agents, a biocidal agent, a foam regulator, a binder, an anti-caking agent, an activator, a catalyst, a thickener, a stabilizer, a fragrance, a soil suspending agent, a filler, a brightener, a UV protectant, an enzyme, or a mixture thereof.

* * * * *

UNITED STATES PATENT AND TRADEMARK OFFICE

CERTIFICATE OF CORRECTION

PATENT NO. : 6,534,464 B1
DATED : March 18, 2003
INVENTOR(S) : Paul Danton Huish et al.

It is certified that error appears in the above-identified patent and that said Letters Patent is hereby corrected as shown below:

Column 14,
Line 57, after the words "and about 3:", please delete the space after "3:" and before "1." to change "3: 1" to -- 3:1. --

Column 15,
Line 8, please delete the words ", the ester formation".

Signed and Sealed this

Seventeenth Day of June, 2003

JAMES E. ROGAN
*Director of the United States Patent and Trademark Office*